US008294049B2

(12) United States Patent
Tsuduki

(10) Patent No.: US 8,294,049 B2
(45) Date of Patent: Oct. 23, 2012

(54) ROTARY SWITCH

(75) Inventor: Shiro Tsuduki, Osaka (JP)

(73) Assignee: Hosiden Corporation, Osaka (JP)

( * ) Notice: Subject to any disclaimer, the term of this patent is extended or adjusted under 35 U.S.C. 154(b) by 302 days.

(21) Appl. No.: 12/663,274

(22) PCT Filed: Jan. 9, 2009

(86) PCT No.: PCT/JP2009/050247

§ 371 (c)(1),
(2), (4) Date: Mar. 30, 2010

(87) PCT Pub. No.: WO2009/098914

PCT Pub. Date: Aug. 13, 2009

(65) Prior Publication Data

US 2010/0200384 A1 Aug. 12, 2010

(30) Foreign Application Priority Data

Feb. 8, 2008 (JP) ..... 2008-029218

(51) Int. Cl.
*H01H 13/70* (2006.01)

(52) U.S. Cl. ..... 200/5 R; 200/564; 200/565

(58) Field of Classification Search ..... 116/303, 116/286, 284; 362/26; 200/5 R, 179, 4, 200/11 R, 11 D, 11 DA, 11 G, 564–565; 341/35; 345/184

See application file for complete search history.

(56) References Cited

U.S. PATENT DOCUMENTS 6,396,006 B1 * 5/2002 Yokoji et al. ..... 200/4
6,784,384 B2 * 8/2004 Park et al. ..... 200/11 R (Continued)

FOREIGN PATENT DOCUMENTS

JP 2005-190947 7/2005

(Continued)

OTHER PUBLICATIONS

First Office Action issued on Oct. 11, 2011 by the Japanese Patent Office for counterpart foreign patent application JP 2008-029218.

*Primary Examiner* — R. A. Smith
*Assistant Examiner* — Tania Courson
(74) *Attorney, Agent, or Firm* — David N. Lathrop

(57) ABSTRACT

A rotary switch includes a body having a fixing surface, a thin-plate-like flexible substrate fixed onto the fixing surface and having a plurality of first electrodes arranged along a first circle on a first electrode placement surface, a thin-plate-like electrode plate having a plurality of second electrodes arranged along a second circle on a second electrode placement surface facing the first electrode placement surface, the electrode plate being rotatable along the second circle, a dial having an operating surface and rotatable along the second circle, and a resilient member interposed between an opposite operating surface of the dial and a resilient member surface. The electrode plate has a plurality of electrode plate protrusions in the circumferential direction on the resilient member surface. The dial has a plurality of dial protrusions in the circumferential direction on the opposite operating surface.

8 Claims, 14 Drawing Sheets

U.S. PATENT DOCUMENTS

| | | | | |
|---|---|---|---|---|
| 7,087,848 | B1 * | 8/2006 | Yamasaki et al. | 200/6 A |
| 7,297,882 | B2 * | 11/2007 | Badarneh | 200/5 R |
| 7,297,883 | B2 * | 11/2007 | Rochon et al. | 200/5 R |
| 7,312,411 | B2 * | 12/2007 | Osada et al. | 200/6 A |
| 7,368,673 | B2 * | 5/2008 | Sato | 200/5 R |
| 7,405,728 | B2 * | 7/2008 | Arakawa et al. | 345/184 |
| 7,442,886 | B2 * | 10/2008 | Hashida | 200/5 R |
| 7,462,787 | B1 * | 12/2008 | Kang et al. | 200/4 |
| 7,498,527 | B2 * | 3/2009 | Koizumi et al. | 200/5 R |
| 7,550,685 | B2 * | 6/2009 | Tsuduki | 200/6 A |
| 7,602,268 | B2 * | 10/2009 | Miyasaka et al. | 335/205 |
| 7,860,237 | B2 * | 12/2010 | Takashima et al. | 379/433.06 |
| 8,073,138 | B2 * | 12/2011 | Takashima et al. | 379/433.06 |
| 8,089,011 | B2 * | 1/2012 | Wang | 200/43.01 |
| 2002/0166754 | A1 * | 11/2002 | Ohba et al. | 200/4 |
| 2006/0230838 | A1 * | 10/2006 | Miyasaka et al. | 73/753 |
| 2010/0026532 | A1 * | 2/2010 | Shimizu et al. | 341/35 |

FOREIGN PATENT DOCUMENTS

| | | |
|---|---|---|
| JP | 2005-228040 | 8/2005 |
| JP | 2006-073311 | 3/2006 |
| JP | 2006-286458 | 10/2006 |
| JP | 2008-004504 | 1/2008 |
| WO | WO 2007/032432 | 3/2007 |
| WO | WO 2008/132930 | 11/2008 |

* cited by examiner

INTER-SET KEY PROTRUSION AREA 12C

ROTARY SWITCH

TECHNICAL FIELD

The present invention relates to a rotary switch that detects the direction in which a dial is rotated and the angle of rotation of the dial.

BACKGROUND ART

A conventional rotary switch primarily includes a substrate, a magnetic field detection element (IC) disposed on the substrate, a rotatable dial, and an annular magnet that can rotate integrally with the dial. When the dial is rotated, the annular magnet is rotated integrally therewith, and the magnetic field detection element senses the change in magnetic flux resulting from the rotation of the annular magnet. The magnetic field detection element thus detects the direction and amount of the rotation. The details of the technology are described in the patent literature 1.

Patent literature 1: Japanese Patent Application Laid Open No. 2006-73311

DISCLOSURE OF THE INVENTION

Problems to be Solved by the Invention

When the dial is unstable, for example, the annular magnet, which produces a rotation signal, may not be parallel to the Hall IC, which detects the change in magnetic flux, (or a flexible substrate) in some cases. In this case, the magnetic field detection element cannot detect the change in magnetic flux accurately. As a result, the direction in which the dial is rotated and the amount of rotation of the dial cannot disadvantageously be detected.

Means to Solve the Problems

A rotary switch of the present invention at least includes a body having a fixing surface, a flexible substrate, an electrode plate, a dial, and a resilient member. The flexible substrate has a thin-plate-like shape, is fixed onto the fixing surface, and has a plurality of first electrodes arranged along a first circle on the surface that is opposite the surface in contact with the fixing surface (hereinafter referred to as a "first electrode placement surface"). The electrode plate has a thin-plate-like shape, has a plurality of second electrodes arranged along a second circle on a second electrode placement surface facing the first electrode placement surface, and is rotatable along the second circle. The dial has an operating surface and is rotatable along the second circle. The resilient member is interposed between the surface that is opposite the operating surface of the dial (hereinafter referred to as an "opposite operating surface") and the surface that is opposite the second electrode placement surface of the electrode plate (hereinafter referred to as a "resilient member surface"). The electrode plate has a plurality of electrode plate protrusions in the circumferential direction on the resilient member surface. The dial has a plurality of dial protrusions in the circumferential direction on the opposite operating surface. Each of the electrode plate protrusions is positioned between the corresponding pair of the dial protrusions or each of the dial protrusions is positioned between the corresponding pair of the electrode plate protrusions.

Effects of the Invention

According to the rotary switch of the present invention, the resilient member showing resiliency is interposed between the dial and the electrode plate. Therefore, the resilient member exerts a load on the electrode plate constantly toward the flexible substrate. The electrode plate can therefore remain parallel to the flexible substrate, for example, even when the dial is unstable. As a result, the change in capacitance can be detected accurately, whereby the angle and direction of rotation of the dial can be accurately detected.

BEST MODES FOR CARRYING OUT THE INVENTION

Figure 1:
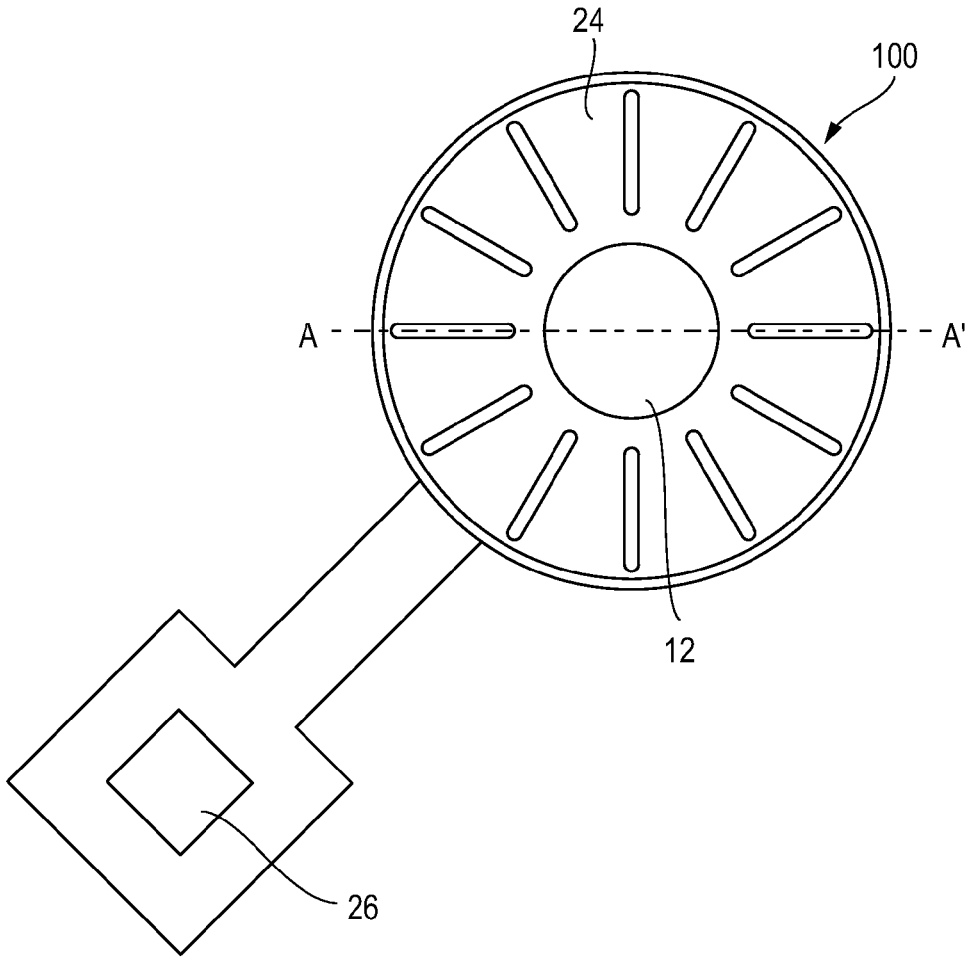
FIG. 1 is a plan view of a rotary switch of the present invention.
Figure 2:
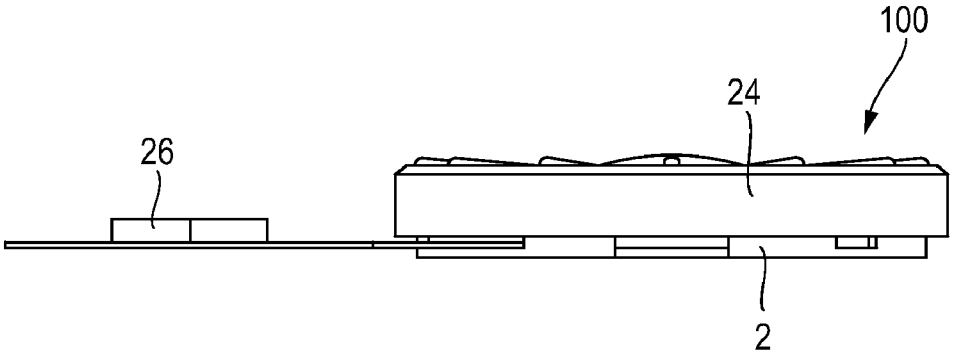
FIG. 2 is a side view of the rotary switch of the present invention.
Figure 3:
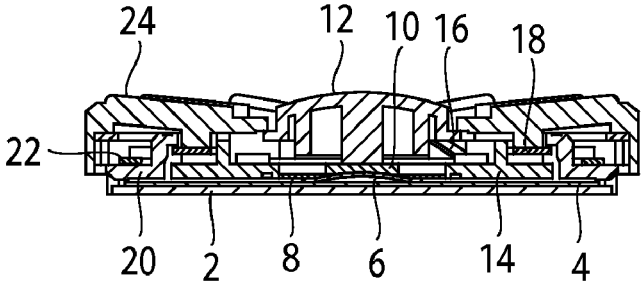
FIG. 3 is a cross-sectional view of the rotary switch of the present invention taken along the line AA' shown in FIG. 1.
Figure 4:
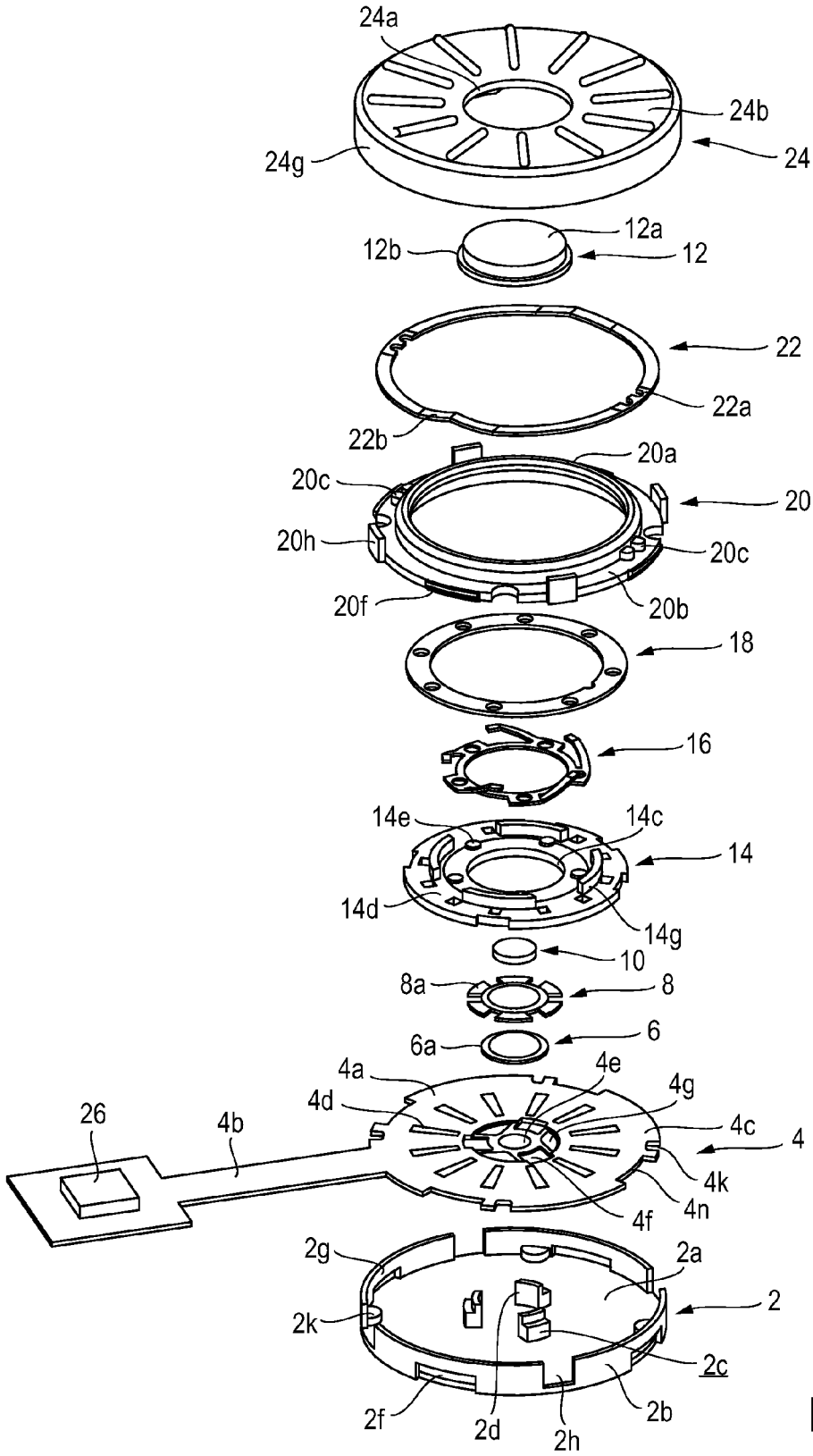
FIG. 4 is an exploded perspective view of the rotary switch of the present invention when viewed from above.
Figure 5:
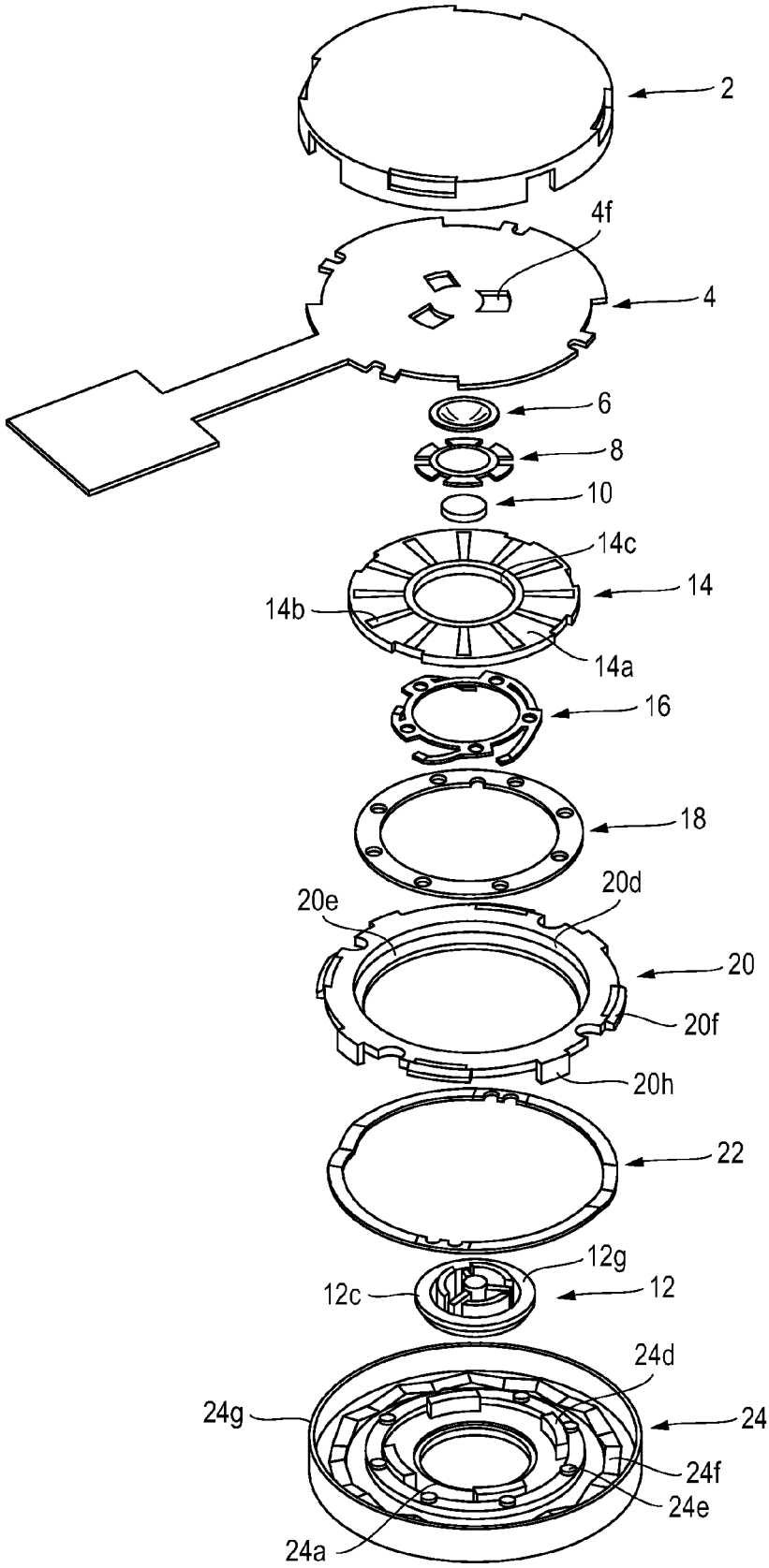
FIG. 5 is an exploded perspective view of the rotary switch of the present invention when viewed from below.

A rotary switch 100 will be described below as a specific example of the present invention. It is noted that the technical spirit of the present invention is not limited to the specific structure shown as the rotary switch 100. FIG. 1 shows the exterior of the rotary switch 100 viewed from directly above. FIG. 2 shows the exterior of the rotary switch 100 viewed directly sideward. FIG. 3 is a cross-sectional view of the rotary switch 100 taken along the line AA' shown in FIG. 1. FIG. 4 is an exploded perspective view of the rotary switch 100 viewed from above. FIG. 5 is an exploded perspective view of the rotary switch 100 viewed from below.

As shown in FIG. 4, a body 2 has a substantially circular, thin-plate-like shape. The body 2 has a fixing surface 2*a* and an outer circumferential wall 2*b* along the outer circumference of the body 2. A plurality of body protrusions 2*c* are formed on the fixing surface 2*a* in the circumferential direction. The body protrusions 2*c* have the same shape, and the cross section of each of the body protrusions 2*c* taken along a plane parallel to the fixing surface 2*a* (hereinafter simply referred to as a "cross section") has an arcuate shape provided along a circle. In the example shown in FIG. 4, the body protrusions 2*c* are formed at three locations at angular intervals of 120 degrees. A flexible substrate 4 includes a circular part 4*a* having a disk-like shape and fixed onto the fixing surface 2*a* and a holding part 4*b* that holds a capacitance detection element (IC) 26. Protrusions 2*k*, each of which having a hemispherical cross-sectional shape, are provided along the outer circumference of the fixing surface 2*a* at angular intervals of 90 degrees. Cutouts 4*k*, each of which having a hemispherical cross-sectional shape, are provided along the outer circumference of the circular part 4*a* at angular intervals of 90 degrees. Each of the protrusions 2*k* fits in the corresponding one of the cutouts 4*k*, and the tip of the protrusion 2*k* is, for example, thermally caulked, whereby the circular part 4*a* is fixed to the body 2.

Figure 6:
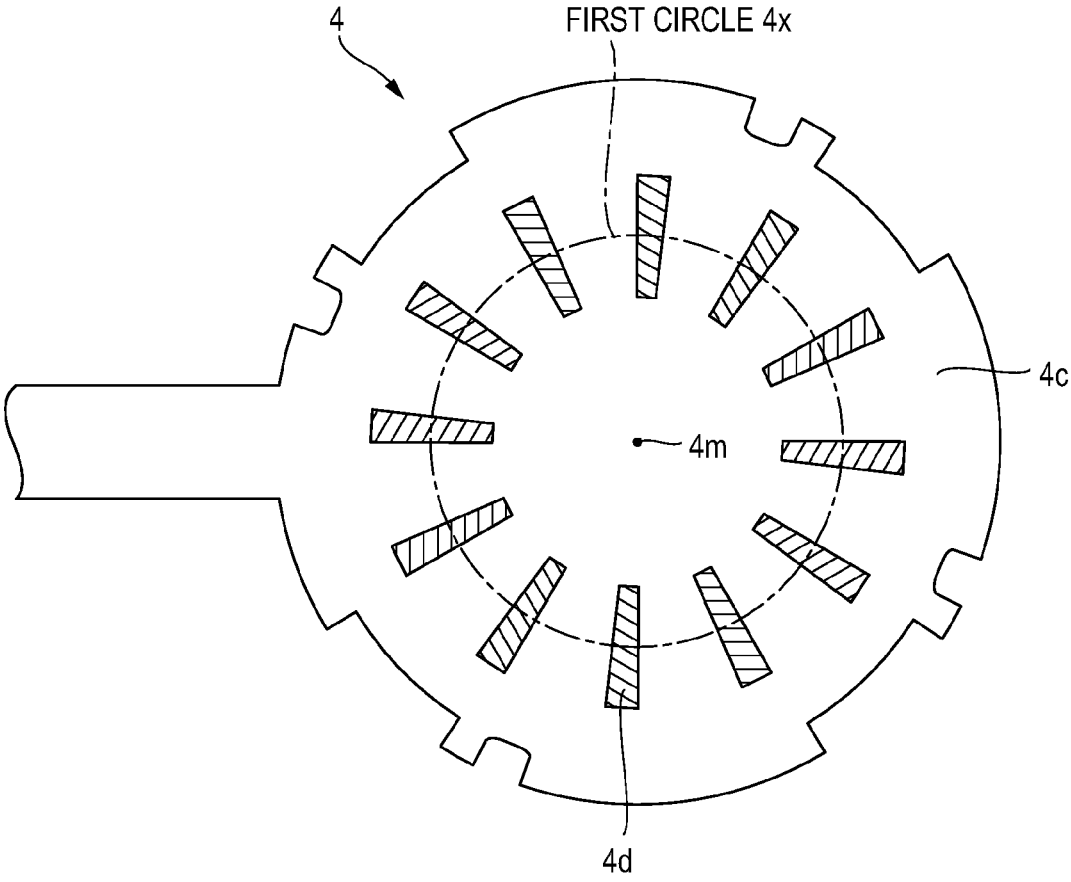
FIG. 6 is a plan view primarily showing first electrodes 4*d;*

The flexible substrate 4 has a plurality of electrodes (hereinafter referred to as "first electrodes 4*d*") arranged on the surface (hereinafter referred to as a "first electrode placement surface 4*c*") that is opposite the surface in contact with the fixing surface 2*a* along a circle (hereinafter referred to as a "first circle 4*x*"). FIG. 6 is a plan view of the first electrode placement surface 4*c* viewed from directly above, on which the first electrodes 4*d* are arranged. FIG. 6 primarily shows the first electrodes 4*d*. The hatched portions in FIG. 6 represent the first electrodes 4*d*. In the example shown in FIGS. 4 and 6, the number of first electrodes 4*d* is twelve. In the example, the first circle 4*x* and the circular part 4*a* share the same center 4*m*. A central fixed contact 4*e* is provided at the center of the circular part 4*a* on the first electrode placement surface 4*c* (see FIG. 4). Three protrusion through holes 4*f*, through which the three body protrusions 2*c* pass, are provided along the circle around the central fixed contact 4*e*. A peripheral fixed contact 4*g* is provided between protrusion through holes 4*f* adjacent in the circumferential direction. In the example shown in FIG. 4, the peripheral fixed contact 4*g* is provided at three locations. The three body protrusions 2*c* pass through the three respective protrusion through holes 4*f*.

A snap plate 6 (movable contact) having a circular domical shape is disposed on the central fixed contact 4*e*. The snap plate 6 changes its shape from an upward-convex shape to a downward convex shape when clicked. Further, a tape 8 is disposed on the snap plate 6. The tape 8 has a circular shape, and has six fixing parts 8*a* along the outer circumference but the number of fixing parts 8*a* is not limited to six. The six fixing parts 8*a* cause the periphery 6*a* of the snap plate 6 to come into contact with and be fixed to the three peripheral fixed contacts 4*g*. A cushion 10 is disposed on the tape 8. The cushion 10 serves to prevent a set key 12 from being unstable in the up/down direction. The cushion 10 is preferably made of PORON®. When the pressable set key 12 (which will be described later) is pressed, the snap plate 6 changes its shape from an upward-convex shape to a downward convex shape, and the snap plate 6 comes into electrical contact with the central fixed contact 4*e*. A detection part (not shown) detects the contact and senses that the set key 12 has been pressed.

Conventionally, it has not been easy to position the snap plate 6, and misalignment of the snap plate 6 has caused degradation in tactile response and other problems. A preferred method for readily positioning the snap plate 6 will now be described.

Figure 7:
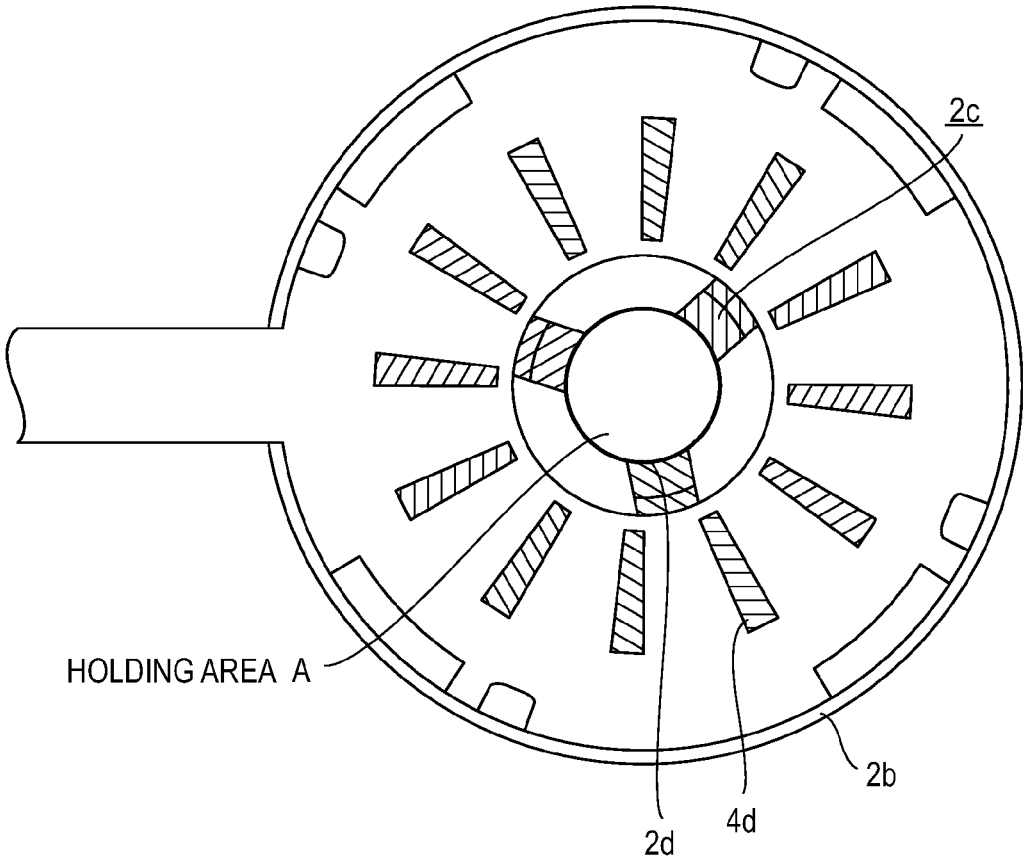
FIG. 7 is a plan view of a flexible substrate 4 fixed to a body 2 and viewed from directly above, and primarily shows a holding area.

FIG. 7 is a plan view of the flexible substrate 4 fixed onto the fixing surface 2*a* of the body 2 when viewed from directly above. To simplify the description, FIG. 7 primarily shows the body protrusions 2*c* having passed through the protrusion through holes 4*f*, but the central fixed contact 4*e* and the peripheral fixed contacts 4*g* are omitted. The hatched portions in FIG. 7 represent the body protrusions 2*c* and the first electrodes 4*d*. As shown in FIG. 7, the inner circumferential surface 2*d* of the three body protrusions 2*c* forms a surrounded area (surrounded by the thick line). The area is hereinafter referred to as a holding area A. The snap plate 6 may be held in the holding area A. Holding the snap plate 6 allows the snap plate 6 to be readily positioned, whereby the problem described above is solved. Further, reduction in the misalignment allows a user to operate the set key 12 with an excellent tactile sensation. Since the degradation in the tactile sensation due to the misalignment can be reduced, the size of the snap plate and hence the size of the rotary switch 100 can be reduced. Moreover, designing the snap plate 6 in such a way that the periphery 6*a* thereof abuts the inner circumferential surface 2*d* of the three body protrusions 2*c* allows the snap plate 6 to be more readily positioned.

The set key 12 has a thin cylindrical shape, and one end thereof is blocked with a circular surface. The blocking surface is a pressing surface 12*a* pressed, for example, by the user. A flange 12*b* is provided along the outer circumference of the lower end of the set key 12. The diameter of the set key 12 including the flange 12*b* is greater than the diameter of a through hole 24*a* in a dial 24 (which will be described later). The set key 12 will not therefore disengage from the dial 24.

Figure 8:
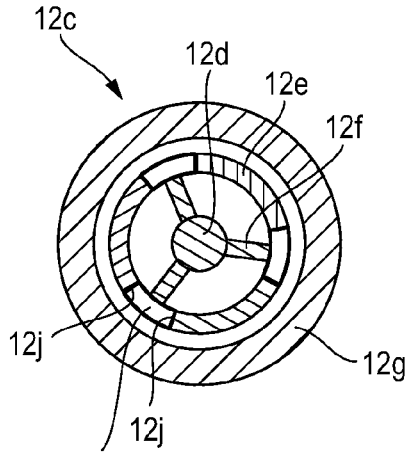
FIG. 8 is a plan view showing an opposite pressing surface of a set key.

FIG. 8 is a plan view of the set key 12 and shows an opposite pressing surface 12*c* that is opposite the pressing surface 12*a*. The hatched portions in FIG. 8 represent the surfaces present on the side where the opposite pressing surface 12*c* is viewed. A central set key protrusion 12*d* and a plurality of (three in the example) circumferential set key protrusions 12*e* are formed on the opposite pressing surface 12*c*. The central set key protrusion 12*d* is positioned at the center of the opposite pressing surface 12*c*, and the circumferential set key protrusions 12*e* are disposed along a circle around the set key protrusion 12*d*. The central set key protrusion 12*d* is securely fixed by three fixing protrusions 12*f* extending from the center of the opposite pressing surface 12*c* in the radial direction. As shown in FIG. 5, which shows the set key 12, the central set key protrusion 12*d*, the three circumferential set key protrusions 12*e*, and the three fixing protrusions 12*f* jut out from the bottom surface 12*g* of the flange. The central set key protrusion 12*d* faces the cushion 10, and pressing the set key 12 causes the central set key protrusion 12*d* to press the cushion 10. As a result, the snap plate 6 changes its shape from an upward-convex shape to a downward convex shape. The cross section of each of the circumferential set key protrusions 12*e* has an arcuate shape along a circle.

Figure 9:
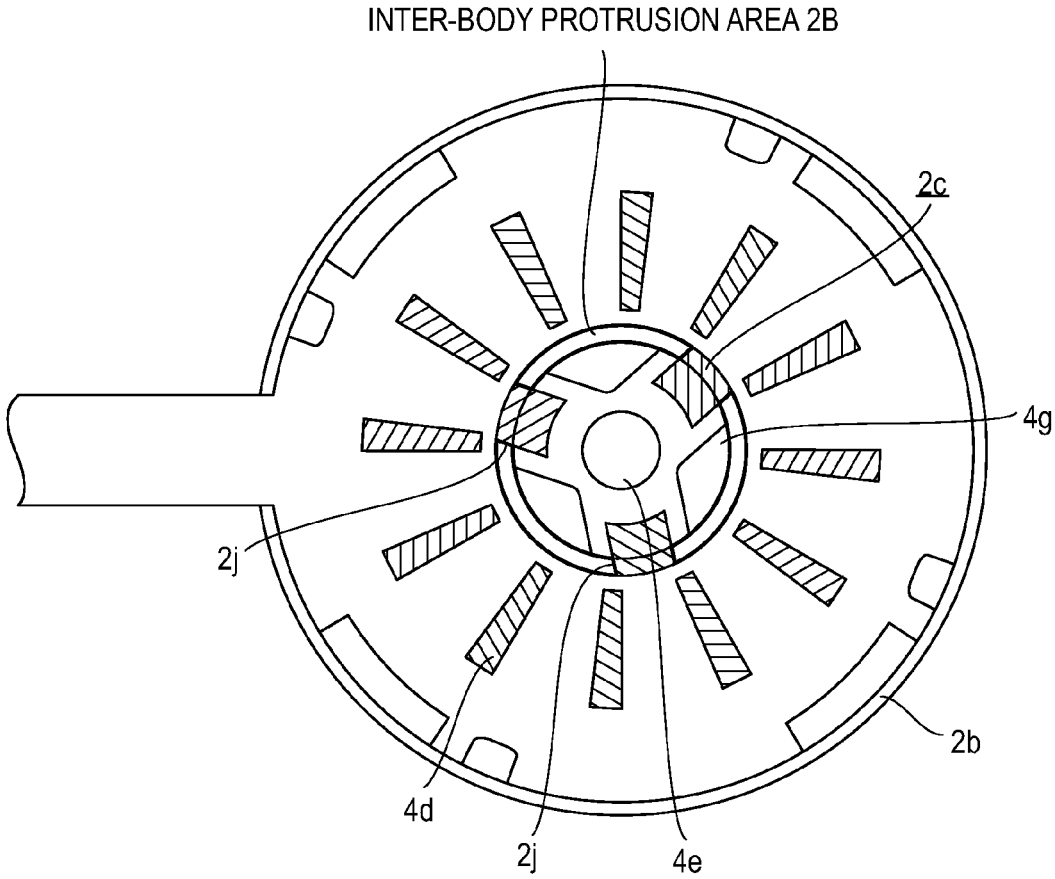
FIG. 9 is a plan view of the flexible substrate 4 fixed to the body 2 and viewed from directly above, and primarily shows inter-body protrusion areas.

A preferred method for preventing the set key 12 from rotating will now be described. FIG. 9 is a plan view of the flexible substrate 4 fixed onto the fixing surface 2*a* of the body 2 and viewed from directly above. The hatched portions in FIG. 9 represent the body protrusions 2*c* and the first electrodes 4*d*. The three body protrusions 2*c* shown in FIG. 9 have passed through the protrusion through holes 4*f*. In the area where the three body protrusions 2*c* having passed through the protrusion through holes 4*f* are present, body protrusions 2*c* adjacent in the circumferential direction form an area surrounded by a thick line (hereinafter referred to as an "inter-body protrusion area 2B"). Similarly, as shown in FIG. 8, circumferential set key protrusions 12*e* adjacent in the circumferential direction form an area surrounded by a thick line (hereinafter referred to as an "inter-set key protrusion area 12C"). The inter-set key protrusion area 12C and the inter-body protrusion area 2B viewed from directly above have arcuate shapes along respective circles. In the example shown in FIG. 9, the inter-body protrusion area 2B is produced at three locations, and the cross-sectional shapes thereof are the same. Similarly, the inter-set key protrusion area 12C is produced at three locations, and the shapes thereof are the same. The cross-sectional shape of each of the inter-body protrusion area 2B shown in FIG. 9 is designed to be the same as the cross-sectional shape of each of the circumferential set key protrusions 12*e* shown in FIG. 8. Each of the three circumferential set key protrusions 12*e* may be positioned between two body protrusions 2*c* having passed through the corresponding protrusion through holes 4*f*. Now, the circumferentially opposing surfaces of adjacent body protrusions 2*c* are called 2*j* (see FIG. 9), and the circumferentially opposing surfaces of adjacent circumferential set key protrusions 12*e* are called 12*j* (see FIG. 8). The body protrusions 2*c* and the circumferential set key protrusions 12*e* are preferably positioned in such a way that the opposing surfaces 2*j* of each of the body protrusions 2*c* abut the opposing surfaces 12*j* of the corresponding circumferential set key protrusion 12*e*. This configuration can more securely prevent the set key 12 from rotating.

An electrode plate 14 has a circular thin-plate-like shape, has a central through hole 14*c*, is made of a resin, and is formed by molding. The set key 12, when pressed, passes through the through hole 14*c*. The electrode plate 14 has a second electrode placement surface 14*a* that faces the first electrode placement surface 4*c*. The electrode plate 14 in the example has a plurality of second electrodes arranged on the second electrode placement surface 14*a* along a circle (hereinafter referred to as a "second circle 14*x*"). In the example, the number of arranged second electrodes is twelve. When the electrode plate 14 is made of a resin and formed by molding, it is preferred to form the electrode plate 14 by insert-molding the second electrodes. The insert-molding can reduce the number of parts, reduce the thickness of the rotary switch 100 itself, and precisely produce a signal representing the rotation of the electrode plate.

Figure 10:
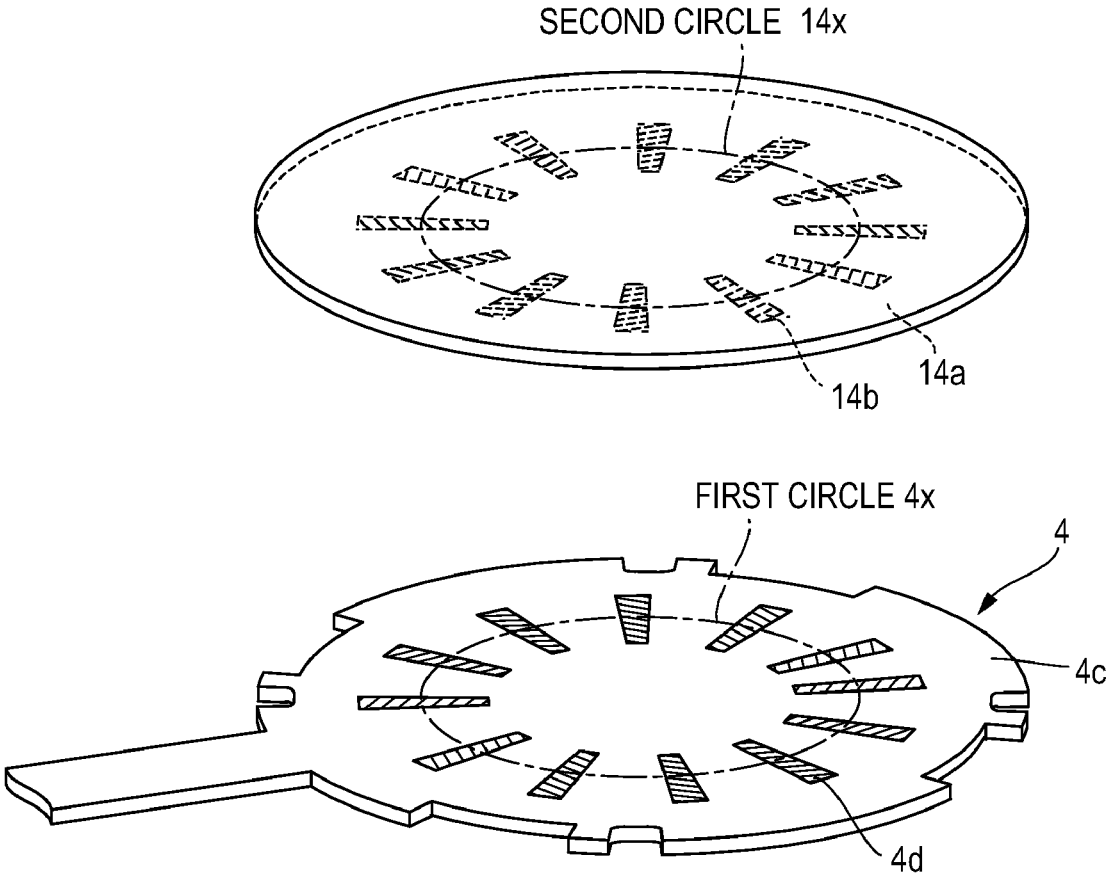
FIG. 10 is a diagrammatical view showing that a first electrode placement surface faces a second electrode placement surface.

FIG. 10 diagrammatically shows the first electrode placement surface 4*c*, twelve first electrodes 4*d* arranged thereon, the second electrode placement surface 14*a*, and twelve second electrodes 14*b* arranged thereon. In FIG. 10, the portions hatched by the solid lines represent the first electrodes 4*d*, and the portions hatched by the dotted lines represent the second electrodes 14*b*. In FIG. 10, the through hole 14*c* is omitted. The details of the relationship between the arrangement of the first electrodes 4*d* and that of the second electrodes 14*b* are described in a PCT application (WO 2008/132930 A1, hereinafter referred to as "patent literature A") that is based on Japanese Patent Application No. 2007-110410 and had not been published at the time when the priority application (Japanese Patent Application No. 2008-029218) of the present application was filed. An example of the relationship between the arrangement of the first electrodes 4*d* and that of the second electrodes 14*b* will be briefly described.

Figure 11:
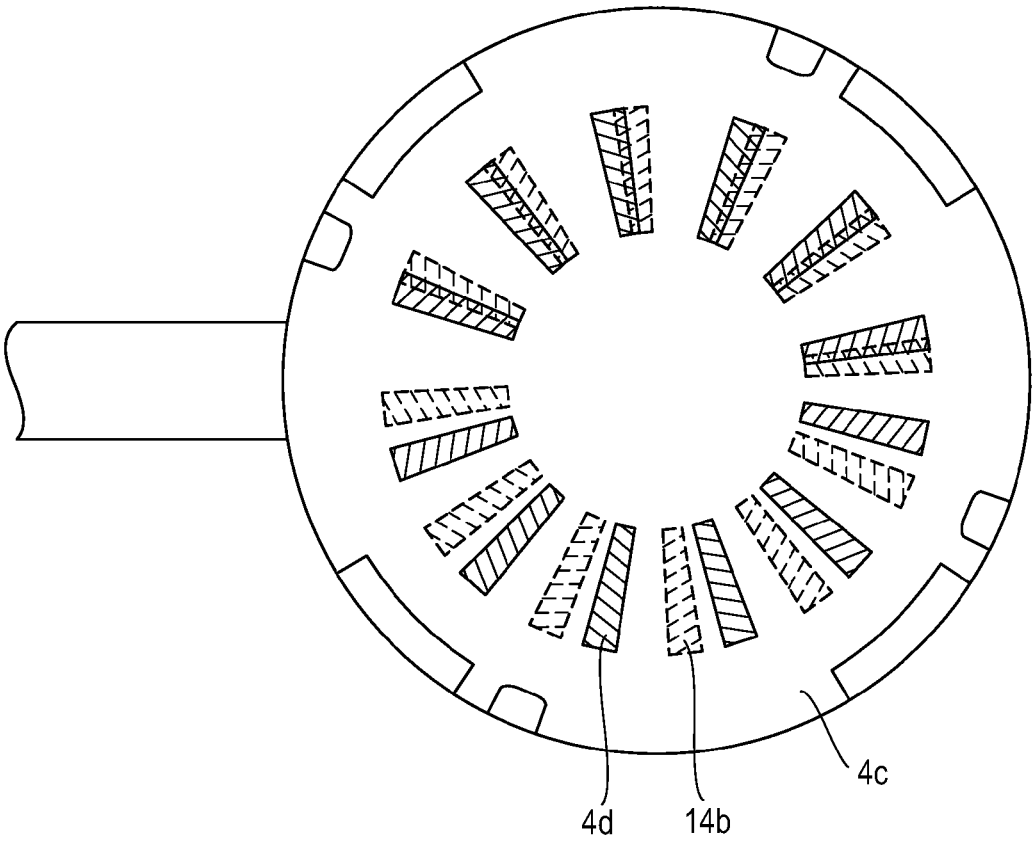
FIG. 11 is a diagrammatical view showing an example of the positional relationship between first electrodes and second electrodes.

FIG. 11 shows an example of the positional relationship between the twelve first electrodes 4*d* and the twelve second electrodes 14*b*. To simplify the description, the electrode plate 14 is omitted. In FIG. 11, the portions hatched by the solid lines represent the first electrodes 4*d*, and the portions hatched by the dotted lines represent the second electrodes 14*b*. As shown in FIG. 11, six adjacent first electrodes 4*d* (referred to as a-phase electrodes in the patent literature A) or six adjacent second electrodes 14*b* are shifted by a fixed angle in the rotating direction. This arrangement allows the detection part to detect the angle and direction of the rotation from the change in capacitance sensed by the capacitance detection element 26. In the example shown in FIG. 11, six of the first electrodes 4*d* are shifted.

Further, interposing a spacer or an insulating sheet between the flexible substrate 4 and the electrode plate 14 keeps the distance d between the first electrode placement surface 4*c* and the second electrode placement surface 14*a* constant.

Figure 12:
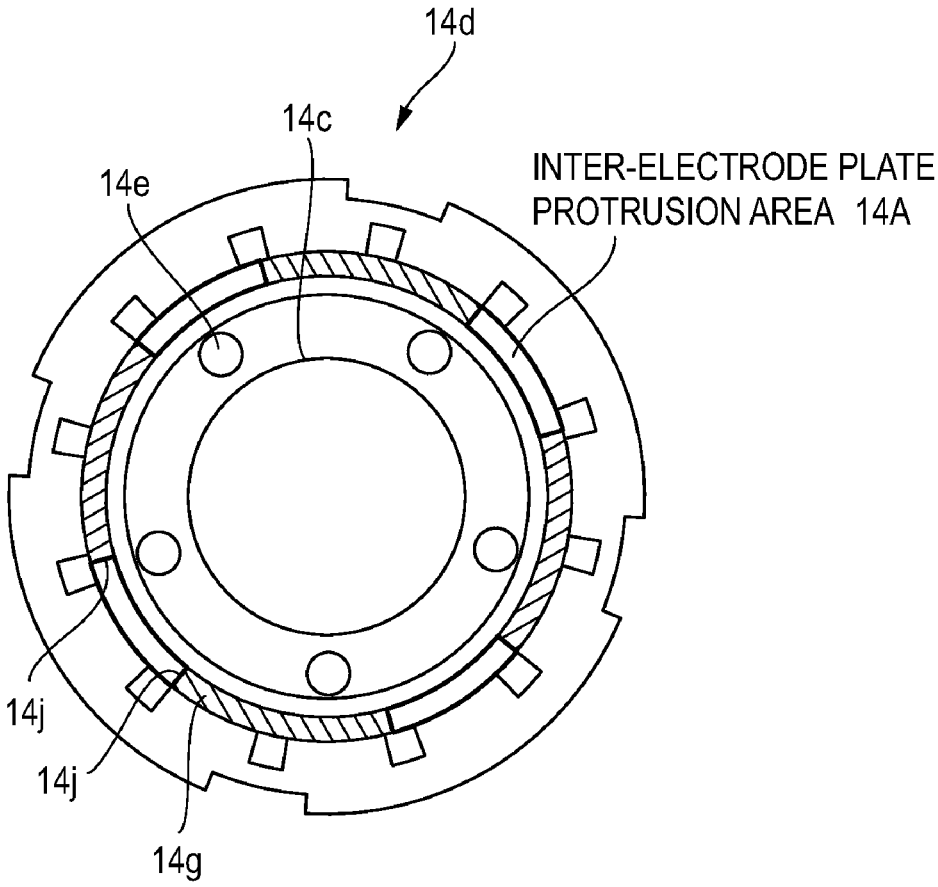
FIG. 12 is a plan view of an electrode plate viewed from the side where a resilient member surface is present.

FIG. 12 is a plan view of the electrode plate 14 and shows the surface (hereinafter referred to as a "resilient member surface 14*d*") that is opposite the second electrode placement surface 14*a*. The hatched portions in FIG. 12 represent electrode plate protrusions 14*g*. As shown in FIG. 12, five bosses 14*e* are formed around the through hole 14*c* on the resilient member surface 14*d*, and the electrode plate protrusions 14*g* are formed at a plurality of locations (four in the example) in the circumferential direction in an area outside the five bosses 14*e*. Electrode plate protrusions 14*g* adjacent in the circumferential direction form an inter-electrode plate protrusion area 14A (surrounded by a thick line) (the number of inter-electrode plate protrusion areas 14A is four in the example). The cross section of each of the electrode plate protrusions 14*g* and each of the inter-electrode plate protrusion areas 14A have respective arcuate shapes along a circle when viewed from directly above.

Figure 13:
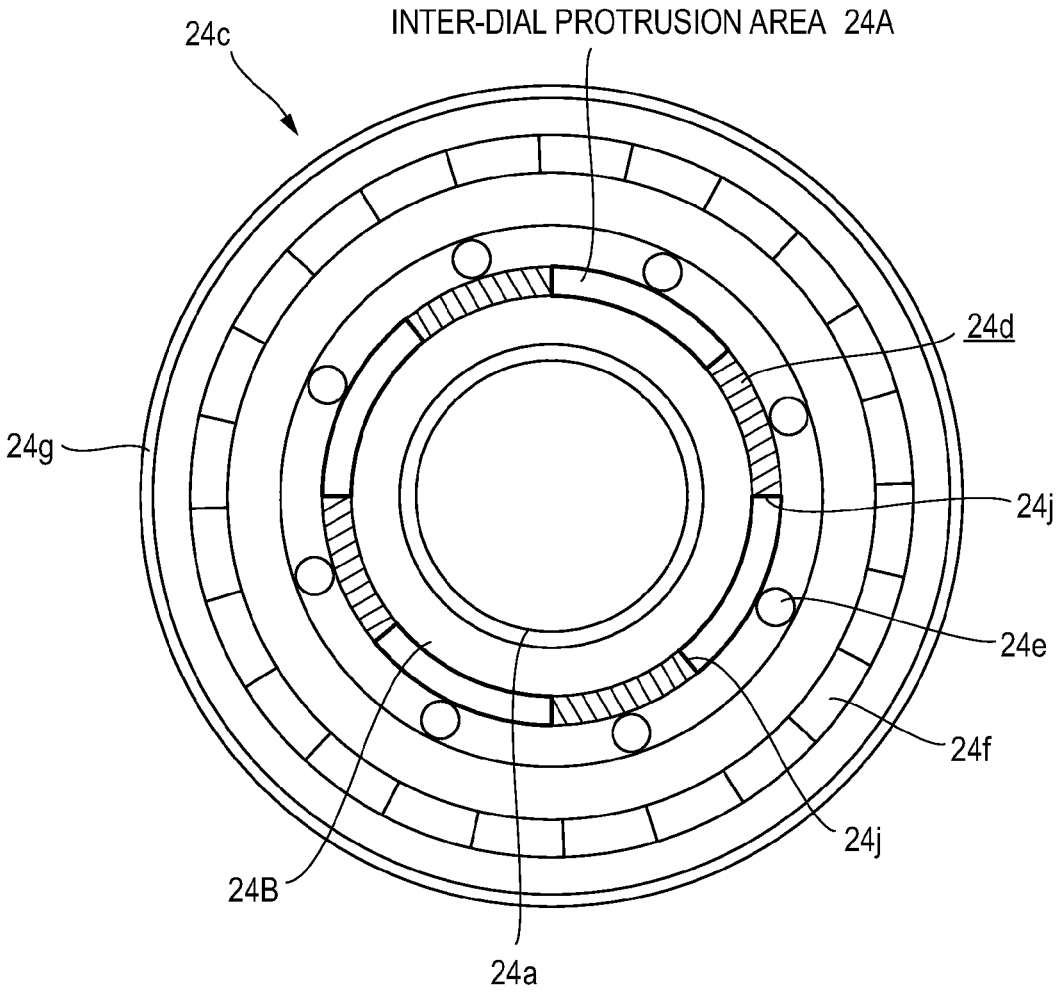
FIG. 13 is a plan view of a dial viewed from the side where an opposite operating surface is present.

On the other hand, the rotatable dial 24 has a circular operating surface 24*b*, as shown in FIG. 4. The surface that is opposite the operating surface 24*b* is called an opposite operating surface 24*c*. An outer circumferential wall 24*g* extending toward the body 2 is provided along the outer circumference of the dial 24. FIG. 13 is a plan view of the dial 24 when viewed from the side where the opposite operating surface 24*c* is present. The hatched portions in FIG. 13 represent dial protrusions 24*d*. An annular contact area 24B, the dial protrusions 24*d*, bosses 24*e*, and an annular recesses and protrusions 24*f* are formed and disposed in this order outward from the through hole 24*a* provided at the center of the opposite operating surface 24*c*. The dial protrusions 24*d* are formed at a plurality of locations (four in the example) in the circumferential direction. The bosses 24*e* are formed at a plurality of locations (eight in the example) in the circumferential direction. The annular recesses and protrusions 24*f* are formed along a circle. Dial protrusions 24*d* adjacent in the circumferential direction form an inter-dial protrusion area 24A (surrounded by a thick line) (the number of inter-dial protrusion areas 24A is four in the example). Each of the bosses 24*e* forms a protrusion. Each of the inter-dial protrusion areas 24A and the cross section of each of the dial protrusions 24*d* have respective arcuate shapes along a circle when viewed from directly above.

At least one of the plurality of electrode plate protrusions 14*g* is positioned between two dial protrusions 24*d* (in an inter-dial protrusion area 24A), or at least one of the plurality of dial protrusions 24*d* is positioned between two electrode plate protrusions 14*g* (in an inter-electrode plate protrusion area 14A). The positioning described above allows the force in the direction in which the dial 24 is rotated to be appropriately transferred to the electrode plate 14. To transfer the force more accurately, the cross-sectional shape of each of the electrode plate protrusions 14*g* is preferably the same as the shape of each of the inter-dial protrusion areas 24A when viewed from directly above, and the cross-sectional shape of each of the dial protrusions 24*d* is preferably the same as the shape of each of the inter-electrode plate protrusion areas 14A when viewed from directly above. In the embodiment, the four electrode plate protrusions 14*g* are positioned in the four respective inter-dial protrusion areas 24A, and the four dial protrusions 24*d* are positioned in the four respective inter-electrode plate protrusion areas 14A (hereinafter referred to as "positioned in place"). Now, the circumferentially opposing surfaces of adjacent dial protrusions 24*d* are called dial protrusion opposing surfaces 24*j*, and the circumferentially opposing surfaces of adjacent electrode plate protrusions 14*g* are called electrode plate protrusion opposing surfaces 14*j*. When the four electrode plate protrusions 14*g* and the four dial protrusions 24*d* are positioned in place, the dial protrusion opposing surfaces 24*j* preferably abut the respective electrode plate protrusion opposing surfaces 14*j*. Positioning the electrode plate protrusions 14*g* and the dial protrusions 24*d* in place as described above allows the dial 24 and the electrode plate 14 to be rotated integrally with each other in the rotating direction.

Figure 14:
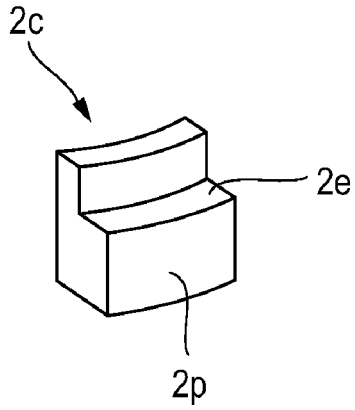
FIG. 14 is an enlarged perspective view of a body protrusion.

A preferred method for rotating the electrode plate 14 accurately around the central axis of the circular part 4*a* will be described. FIG. 14 is an enlarged perspective view of one of the body protrusions 2*c*. Each of the body protrusions 2*c* is cut out at its outer circumferential portion so that a step 2*e* is formed. The step 2*e* is formed to prevent the body protrusion 2*c* from interfering with the flange 12*b* of the set key 12. Now, the outer circumferential surface below the step 2*e* of the body protrusion 2*c* is called 2*p*. The electrode plate 14 can be accurately rotated around the central axis of the circular part 4*a* by designing the inner circumferential surface 14*h* of the through hole 14*c* in the electrode plate 14 to rotatably abut the outer circumferential surfaces 2*p* of the three body protrusions 2*c*.

Figure 15:
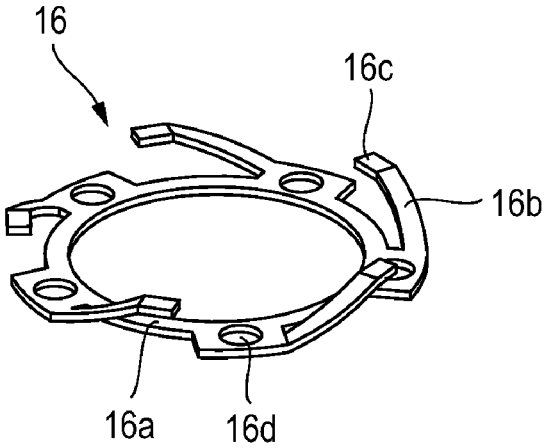
FIG. 15 is an enlarged perspective view of a resilient member.

A resilient member 16 is fixed onto the resilient member surface 14*d* of the electrode plate 14. FIG. 15 is an enlarged perspective view of the resilient member 16. The resilient member 16 includes a ring-shaped fixing part 16*a*, five spring parts 16*b* that are cut at five locations along the circumference of the fixing part 16*a* and bent obliquely upward, and a contact part 16*c* provided at the tip of each of the spring parts 16*b*. A hole 16*d* is provided at the portion of the fixing part 16*a* where each of the spring parts 16*b* is provided. The resilient member 16 may be made of phosphor bronze, which shows resiliency. The bosses 14*e* on the resilient member surface 14*d* are inserted into the respective holes 16*d*, and the tip of each of the bosses 14*e* is, for example, thermally caulked (thermally welded). The thermal caulking allows the resilient member 16 to be fixed onto the resilient member surface 14*d*.

The contact parts 16*c* of the resilient member 16 come into contact with the contact area 24B (see FIG. 13) of the opposite operating surface 24*c* of the dial 24. When the fixing part 16*a* is fixed to the resilient member surface 14*d* and the contact parts 16*c* come into contact with the opposite operating surface 24*c*, the resilience of the spring parts 16*b* exerts a load on the electrode plate 14 constantly toward the body 2. As a result, the electrode plate 14 can remain parallel to the flexible substrate 4, for example, even when the dial 24 is unstable.

As a variation of the above configuration, the fixing part 16*a* may be fixed to the opposite operating surface 24*c*, and the contact parts 16*c* may be brought into contact with the resilient member surface 14*d*. Alternatively, the resilient member 16 may not be fixed to the opposite operating surface 24*c* or the resilient member surface 14*d*, but may be only brought into contact with the two surfaces. Still alternatively, the resilient member 16 shown in FIG. 15 may be replaced with a suspension, which is generally and widely used, because only a load toward the body 2 needs to be applied to the electrode plate 14.

A tactile plate 22 has a ring-like shape and produces a clicking sensation when the dial 24 is rotated. A key top 20 has a through hole 20*a* and hence has a ring-like shape. The key top 20 has a tactile plate fixing surface 20*b*, which faces the opposite operating surface 24*c*. The tactile plate fixing surface 20*b* fixes the tactile plate 22. An exemplary fixing method will be described. The tactile plate fixing surface 20*b* has two protrusions 20*c* on completely opposite sides (that is, four in total). On the other hand, the tactile plate 22 has two recesses 22*a* at the inner circumference on completely opposite sides (that is, four in total). The protrusions 20*c* fit in the recesses 22*a*, and they are fixed to each other, for example, by thermally caulking the tip of each of the protrusions 20*c*. An example of how a clicking sensation is produced will be described. The tactile plate 22 has two bent parts 22*b* on completely opposite sides. Placing the tactile plate 22 and the dial 24 in such a way that the bent parts 22*b* engage the recesses and protrusions 24*f* (see FIG. 13) produces a clicking sensation when the dial 24 is rotated. It is noted that the tactile plate 22 may be omitted.

Figure 16:
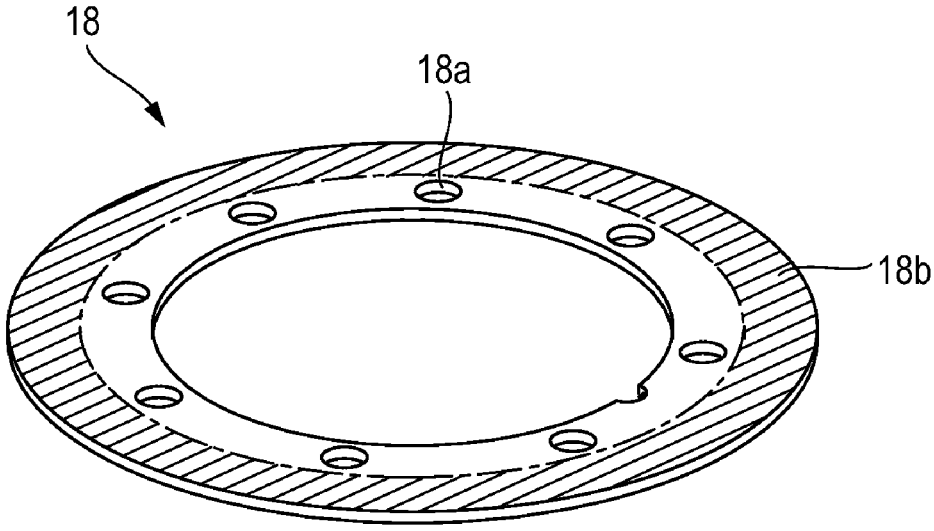
FIG. 16 is an enlarged perspective view of a fixing plate.

The key top 20 and the tactile plate 22 are sandwiched between the dial 24 and a fixing plate 18. In this configuration, the dial 24 is fixed to the key top 20 and the tactile plate 22 but rotatable relative thereto. A specific example of a fixing method will be described. FIG. 16 is an enlarged perspective view of the fixing plate 18. The fixing plate 18 has a plurality of holes 18*a* in the circumferential direction along its ring-like shape. The portion around the circle defined by the plurality of holes 18*a* (hatched portion) is an abutting part 18*b*. As shown in FIG. 5, the key top 20 has an inner flange 20*e* along an inner circumferential wall 20*d* of the through hole 20*a*. The inner flange 20*e* rotatably abuts the abutting part 18*b* of the fixing plate 18. The bosses 24*e* formed on the opposite operating surface 24*c* (see FIG. 13) are inserted into the holes 18*a* in the fixing plate 18 and caulked so that the dial 24 and the fixing plate 18 are fixed to each other. As a result, the key top 20 and the tactile plate 22 are sandwiched between the fixing plate 18 and the dial 24, and the dial 24 is fixed to the key top 20 and the tactile plate 22 but rotatable relative thereto.

To integrally fix the rotary switch 100 and to cause the tactile plate 22 to appropriately produce a clicking sensation, the key top 20 needs to be fixed to the body 2. That is, it is necessary to not only prevent the key top 20 from disengaging in the direction perpendicular to the operating surface 24*b* of the dial (hereinafter simply referred to as the "vertical direction") but also prevent the key top 20 itself from rotating. Since the rotary switch described in the patent literature 1 employs a magnet as a rotary tactile part, the rotary switch itself is disadvantageously thick. Even a mechanical rotary switch (described in Japanese Patent Application Laid Open No. 2001-325859, for example) has a similar problem of a large thickness of the rotary switch itself for ensuring a sufficient height of a brush. Further, a fixing part for fixing the key top 20 to the body 2 is typically necessary, and the fixing part makes the product thicker. A preferred method for fixing the key top 20 to the body 2 without any fixing part will be described.

Figure 17A:
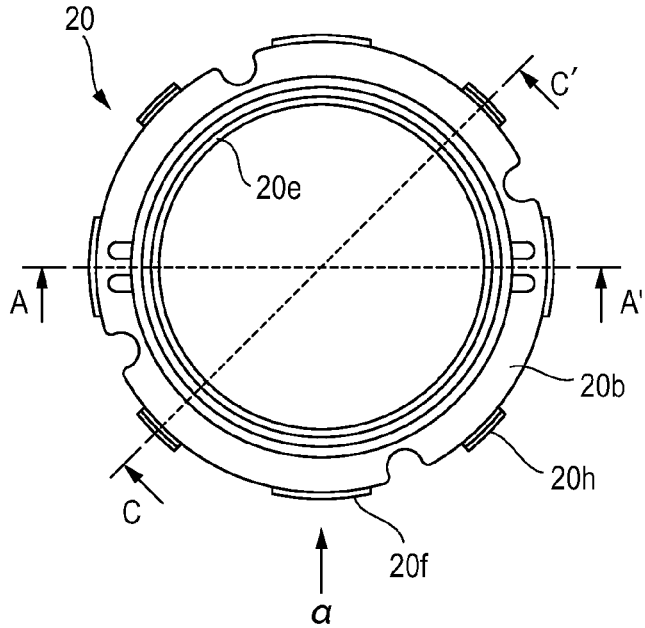
FIG. 17A is a plan view of a key top 20.
Figure 17B:
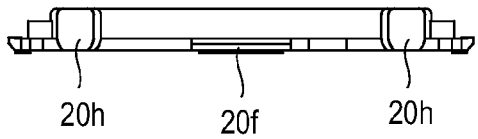
FIG. 17B is a side view of the key top 20.

First, a preferred method for preventing the key top 20 from disengaging in the vertical direction will be described. FIG. 17A is a plan view of the key top 20. FIG. 17B is a side view of the key top 20 viewed in the α direction shown in FIG. 17A.

Figure 17C:
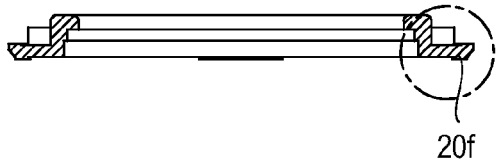
FIG. 17C is a cross-sectional view of the key top 20 taken along the line AA'.
Figure 17D:
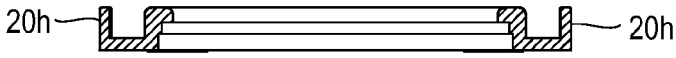
FIG. 17D is a cross-sectional view of the key top 20 taken along the line CC'.
Figure 17E:
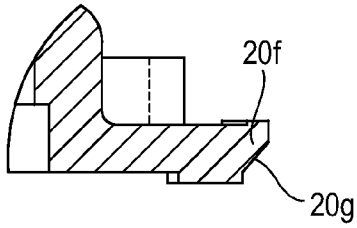
FIG. 17E is an enlarged cross-sectional view of a tab of the key top 20.

FIG. 17C is a cross-sectional view of the key top 20 taken along the line AA' shown in FIG. 17A. FIG. 17D is a cross-sectional view of the key top 20 taken along the line CC" shown in FIG. 17A. As shown in FIGS. 17A and 4, a plurality of protruding tabs 20*f* are formed along the outer circumference of the key top 20. In the example, the protruding tabs 20*f* are formed at four locations along the outer circumference at angular intervals of 90 degrees. FIG. 17E is an enlarged cross-sectional view of one of the tabs 20*f* shown in FIG. 17C. As shown in FIG. 17E, the tab 20*f* has a tapered surface 20*g*.

On the other hand, tab fitting holes 2*f*, into which the tabs 20*f* securely fit, are formed in the outer circumferential wall 2*b* of the body at angular intervals of 90 degrees along the outer circumference. In the example, the tab fitting holes 2*f* are formed at four locations along the outer circumference at angular intervals of 90 degrees. Now, the portion of the inner circumferential surface of the body 2 that is above each of the tab fitting holes 2*f* is called a guiding surface 2*g*. The tapered surfaces 20*g* are guided along the respective guiding surfaces 2*g*, and the tabs 20*f* fit into the tab fitting holes 2*f*. Forming the plurality of tabs 20*f* on the key top 20 and forming the plurality of tab fitting holes 2*f* in the body 2 are advantageous in that the key top 20 will not disengage in the vertical direction while the number of parts is reduced at the same time.

A preferred method for preventing the key top 20 from rotating will next be described. The key top 20 has a plurality of locking parts 20*h* along the outer circumference thereof. In the example, each of the locking parts 20*h* is a protrusion oriented toward the dial 24 and having a rectangular cross-sectional shape. The locking parts 20*h* are formed at four locations along the outer circumference at angular intervals of 90 degrees. On the other hand, cutouts 2*h*, each of which having a rectangular cross-sectional shape, are formed in the outer circumferential wall 2*b* of the body 2. In the example, the cutouts 2*h* are formed at four locations at angular intervals of 90 degrees along the outer circumference. When the locking parts 20*h* engage the respective cutouts 2*h*, the key top 20 will not rotate. The four cutouts 4*k*, each of which having a hemispherical cross-sectional shape, and cutouts 4*n*, each of which being wider than any of the cutouts 4*k*, are provided along the outer circumference of the flexible substrate 4 at angular intervals of 90 degrees. The reason why the cutouts 4*k* and 4*n* are provided will be described. The cutouts 4*k* are provided not to cause the portions where the protrusions 2*k* of the body 2 are thermally caulked and fixed to the cutouts 4*k* of the flexible substrate 4 to interfere with the outer circumference of the key top 20 when the key top 20 is fixed to the body 2. The cutouts 4*n* are provided not to cause the flexible substrate 4 to interfere with the tabs 20*f* of the key top 20 that fit into the tab fitting holes 2*f*.

The dial 24, the body 2, and the set key 12 may be made of resins. The set key 12 may be omitted. In this case, the snap plate 6, the tape 8, the cushion 10, and the central fixed contact 4*e* and the peripheral fixed contacts 4*g* of the flexible substrate 4 are not necessary.

What is claimed is:

1. A rotary switch comprising:

a body having a fixing surface;

a thin-plate-like flexible substrate fixed onto the fixing surface and having a plurality of first electrodes arranged along a first circle on the surface, as a first electrode placement surface, that is opposite the surface in contact with the fixing surface;

a thin-plate-like electrode plate having a plurality of second electrodes arranged along a second circle on a second electrode placement surface facing the first electrode placement surface, the electrode plate being rotatable in the second circle;

a dial having an operating surface and rotatable along the second circle; and a resilient member interposed between the surface, as an opposite operating surface, that is opposite the operating surface of the dial and the surface, as a resilient member surface, that is opposite the second electrode placement surface of the electrode plate, wherein the electrode plate has a plurality of electrode plate protrusions in the circumferential direction on the resilient member surface, the dial has a plurality of dial protrusions in the circumferential direction on the opposite operating surface, and each of the electrode plate protrusions is positioned between the corresponding pair of the dial protrusions or each of the dial protrusions is positioned between the corresponding pair of the electrode plate protrusions.

2. The rotary switch according to claim 1, further comprising:

a set key having a flange along the outer circumference thereof and pressable in the direction perpendicular to the first electrode placement surface; and a snap plate disposed on the first electrode placement surface, wherein the body has a plurality of body protrusions in the circumferential direction on the fixing surface, the flexible substrate has a plurality of protrusion through holes through which the plurality of body protrusions pass and a central fixed contact inside the first circle on the first electrode placement surface, the snap plate faces the central fixed contact and comes into electrical contact with the central fixed contact when the set key is pressed, each of the electrode plate, the resilient member, and the dial has a through hole through which the set key passes, and the snap plate is positioned in an area surrounded by the plurality of body protrusions having passed through the protrusion through holes.

3. The rotary switch according to claim 2, wherein the set key has a plurality of circumferential set key protrusions along a circle on the surface that is opposite the pressing surface, and each of the circumferential set key protrusions is positioned between the corresponding pair of the body protrusions having passed through the protrusion through holes.

4. The rotary switch according to claim 2 or 3, wherein the outer circumferential surface of each of the plurality of body protrusions abuts the inner circumferential surface of the through hole in the electrode plate.

5. The rotary switch according to any one of claims 1 to 3, further comprising:

a tactile plate that is in contact with the opposite operating surface of the dial and produces a clicking sensation when the dial is rotated;

a key top that faces the opposite operating surface of the dial and has a tactile plate fixing surface that fixes the tactile plate and a plurality of locking parts along the outer circumference; and a fixing plate between which and the dial lie the key top and the tactile plate so that the dial is fixed to the key top and the tactile plate but rotatable relative thereto, wherein the body has an outer circumferential wall along the outer circumference and has a plurality of cutouts formed in the outer circumferential wall, and the plurality of locking parts engage the cutouts.

6. The rotary switch according to claim 5, wherein the key top has a plurality of protruding tabs along the outer circumference, the body has a plurality of tab fitting holes formed in the outer circumferential wall, and the plurality of tabs fit into the plurality of tab fitting holes.

7. The rotary switch according to any one of claims 1 to 3, further comprising:

a tactile plate that is in contact with the opposite operating surface of the dial and produces the clicking sensation when the dial is rotated;

a key top that faces the opposite operating surface of the dial and has a tactile plate fixing surface that fixes the tactile plate; and a fixing plate between which and the dial lie the key top and the tactile plate so that the dial is fixed to the key top and the tactile plate but rotatable relative thereto, wherein the key top has a plurality of protruding tabs along the outer circumference, the body has an outer circumferential wall along the outer circumference and has a plurality of tab fitting holes formed in the outer circumferential wall, and the plurality of tabs fit into the plurality of tab fitting holes.

8. The rotary switch according to any one of claims 1 to 3, wherein the electrode plate is formed by insert-molding the plurality of second electrodes.

* * * * *